US006155410A

United States Patent [19]

Davis

[11] Patent Number: 6,155,410

[45] Date of Patent: Dec. 5, 2000

[54] CREDIT CARD CASE

[76] Inventor: Mathew Davis, 79 Kerr Street, Oakville, Canada, L6K 3A2

[21] Appl. No.: 09/413,801

[22] Filed: Oct. 7, 1999

[51] Int. Cl.[7] ..... A45C 11/18

[52] U.S. Cl. ..... 206/39.5; 206/39; 150/147

[58] Field of Search ..... 206/38, 39, 39.5, 206/449, 748, 39.4; 150/147

[56] References Cited

U.S. PATENT DOCUMENTS

| | | | |
|---|---|---|---|
| 1,173,843 | 2/1916 | Morten | 206/39.5 |
| 4,141,400 | 2/1979 | Mangan | 150/147 |
| 4,450,955 | 5/1984 | Featherston | 206/39.6 |
| 4,697,698 | 10/1987 | Holdener | 206/39.4 |
| 5,069,333 | 12/1991 | Chen | 206/39.5 |
| 5,078,265 | 1/1992 | Fugit et al. | 206/39.5 |
| 5,125,505 | 6/1992 | Kurosaki | 206/39.4 |
| 5,718,329 | 2/1998 | Ippolito et al. | 206/38 |
| 5,938,010 | 8/1999 | Osterbye | 206/38 |

FOREIGN PATENT DOCUMENTS

| | | | |
|---|---|---|---|
| 2638619 | 11/1988 | France | 150/147 |

*Primary Examiner*—David T. Fidei
*Attorney, Agent, or Firm*—Dowell & Dowell, P.C.

[57] ABSTRACT

A credit card case has a sectioned structure providing capacity for two or four or more credit cards. Each section provides an area to receive and store two cards and includes an outer panel with a smaller central opening, an inner panel with a larger central opening, and a central dividing panel to separate the cards. The central dividing panel is longer than the inner and outer panels so as to provide a receiving area for the cards. The inner side walls of the card holding areas are tapered near the receiving area to further provide for easy insertion. A separation and retention means is provided towards the top of each card holding area to further assist with card insertion and to prevent unintentional card removal.

9 Claims, 4 Drawing Sheets

CREDIT CARD CASE

BACKGROUND OF THE INVENTION

The present invention relates to a case for credit cards, identification cards, debit cards, ATM cards and the like. In particular, the case is a compact light-weight unit capable of holding at least two such cards while protecting the cards from physical damage and demagnetization. Cards can be conveniently removed from the case when needed.

The use of credit cards, smart cards, identification cards, ATM cards and the like (collectively hereinafter referred to as "cards" or "credit cards") has been increasing rapidly in society over the last several years. Most people now find that they carry less cash and more cards. Traditional wallets for both men and women are often designed to provide quick and easy access to cash and coin. Access to credit cards is typically less convenient as many of these cards, such as identification cards, were intended to be used only occasionally, and not removed and inserted into the wallet on a frequent basis. Accordingly, the traditional wallet is not particularly convenient for a modern user who will often require access to their credit cards more frequently than their cash.

Furthermore, many traditional wallets, particularly those for women, often include metallic latches which may or may not be magnetic in nature. Other times traditional wallets are designed to carry metallic coins in close proximity to credit cards. Both of these configurations can result in possible damage to the magnetic strip of a credit card, including total demagnetization, which renders cards useless.

To remedy this problem many credit cards are carried loose in a users pocket. This can present other problems such as physical damage, loss of a card, and general inconvenience when trying to use a particular card or combination of cards.

Attempts have been made to provide a case for storing cards such as shown and described in U.S. Pat. No. Des. #314,865. This patent shows an ornamental design for a credit card case having a central opening and a "thumb-cut" portion at the end of the case.

U.S. Pat. No. 5,417,328 teaches a case designed to protect credit cards which include integrated electronic components (chips). This invention has a uniquely configured opening for the credit card to accommodate the uniquely shaped cards which contain integrated electronic components.

In general many other informal solutions exist including the use of simple plastic holders, often removed from more traditional wallets.

All of the above devices have proved less than satisfactory for a variety of reasons including poor protection of the cards, cost of manufacture, and lack of capacity to hold a minimum number of cards needed for most users.

SUMMARY OF THE INVENTION

Accordingly it is an object of the present invention to provide a credit card case capable of receiving a variety of credit cards which is generally improved.

It is a further object of the invention to provide the credit card case which is convenient to use.

It is a further object of the invention to provide a credit card case in which the cards can be housed in a highly organized fashion;

It is a further object of the invention to provide a credit card case that will prevent demagnetization and physical damage to the card;

A further object of the invention to provide a credit card case that allows for easy insertion of the cards;

It is a further object of the invention to provide a credit card case that resists unintentional removal of the cards;

It is a further object of the invention to provide a credit card case capable of housing the cards while displaying sufficient area of the cards to permit photo verification and the like without removal from the case;

It is a further object of the invention to provide a credit card case that has a capacity to accommodate modern day users;

Thus there is provided in accordance with the present invention a credit card case having at least one card-carrying section comprising, two outer panels and a central dividing panel, said panels being joined together to form first and second card storage areas, each said card storage area having side walls, a bottom wall, and an open top or receiving area, and each said card storage area being appropriately sized and configured to house standard-sized credit, debit and identification cards.

The novel features which are considered as characteristic for the invention are set forth in particular in the appended claims. The invention itself however, both as to its construction and its method of operation, together with additional objects and advantages thereof, would be best understood from the following description of the specific embodiments when read in connection with the accompanying drawings.

BRIEF DESCRIPTION OF THE DRAWINGS

In order that the invention may be more clearly understood, the preferred embodiment thereof will now be described in detail by way of example, with reference to the accompanying drawings, in which:

FIG. 7 is a cross-sectional view along the line 7—7 of the view shown in FIG. 5;

DETAILED DESCRIPTION OF THE PREFERRED EMBODIMENT

In order to more clearly understand the present invention part numbers assigned in the following parts list will be used:

| Part Number | Description |
|---|---|
| 10 | Credit card case |
| 12 | First section |
| 14 | Second section |
| 16 | Large internal opening |
| 20 | Small external opening |
| 24 | Central dividing panel |
| 26 | Outer panel |
| 27 | Inner panel |
| 28 | Rounded corners |
| 30 | Separating rib |
| 32 | Hinge |
| 34 | Opening for card |
| 36 | Card |
| 38 | Flared sidewall |
| 40 | Sidewall of card opening |
| 42 | Bottom wall of card opening |
| 44 | Receiving area of card opening |
| 100 | High capacity card case |
| 110 | Middle section |
| 112 | Central card storage area |
| 102 | Outer section of high capacity case |
| 104 | Outer section of high capacity case |
| 128 | Rounded corners |
| 130 | Separating rib |

Figure 3:
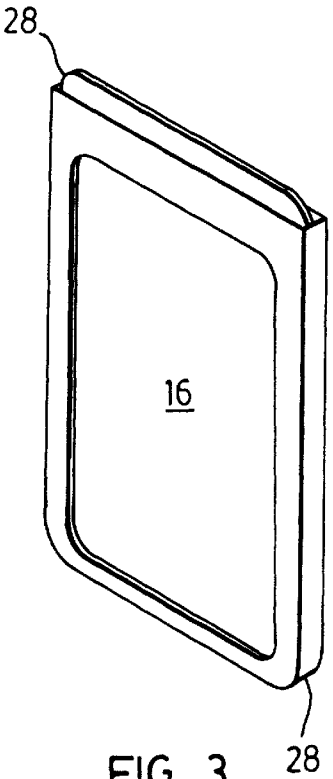
FIG. 3 is perspective view of one section only of the card holder.
Figure 2:
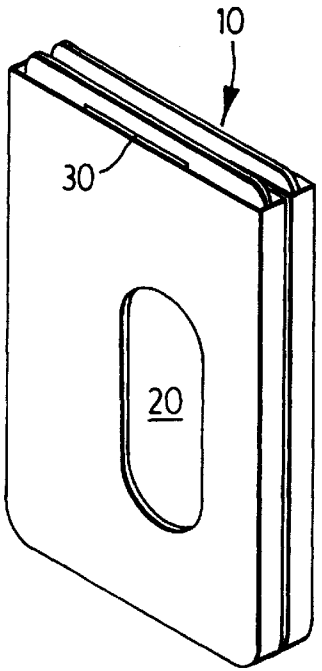
FIG. 2 is a perspective view of the card holder in the closed position.
Figure 1:
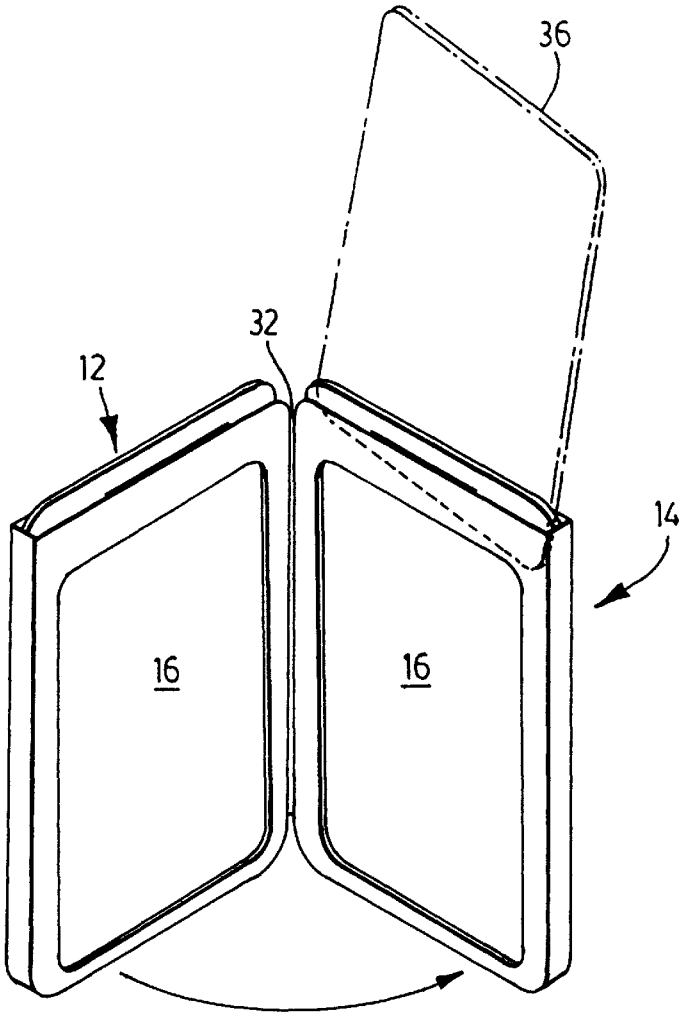
FIG. 1 is perspective view of a first embodiment of the card holder shown in the open position and indicating how a card is inserted.

Referring now to FIGS. 1–3 there is provided a credit card case 10 having at least one section as shown in FIG. 3. The term credit cards is used generically to describe credit cards, debit cards, ATM cards, identification cards, security cards, or any other cards normally carried together by a user.

In the embodiment shown in FIGS. 1 and 2 a credit card case 10 is shown with virtually identical first section and second sections, 12 and 14, joined together at hinge 32. The hinge may be formed in a number of ways. A metallic or plastic piano-type hinge may be used or alternatively hinge means may be created by a simple scored plastic section joining a first section 12 and second section 14 of the case 10. Other hinge means may also be utilized which would be obvious to one skilled in the art.

Figure 4:
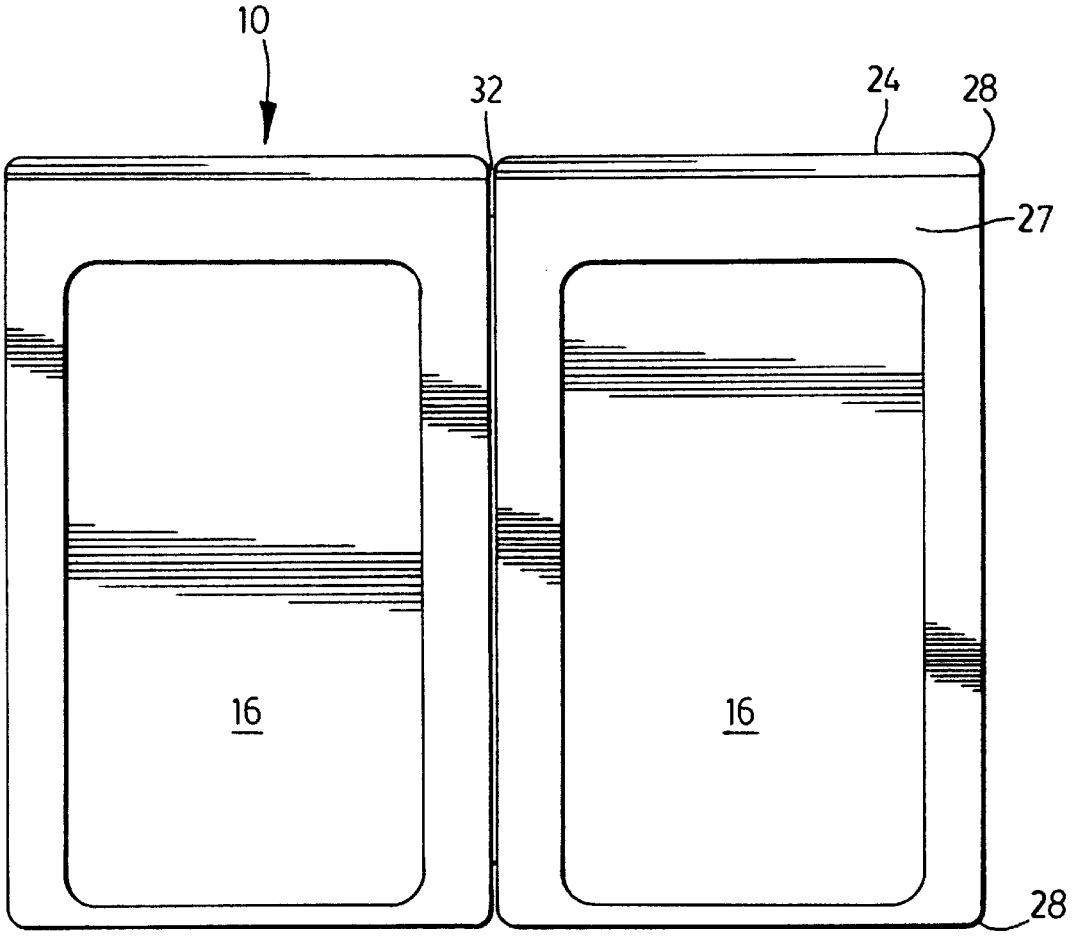
FIG. 4 is an enlarged view of a first embodiment of the card holder shown in the open position.
Figures 5, 6:
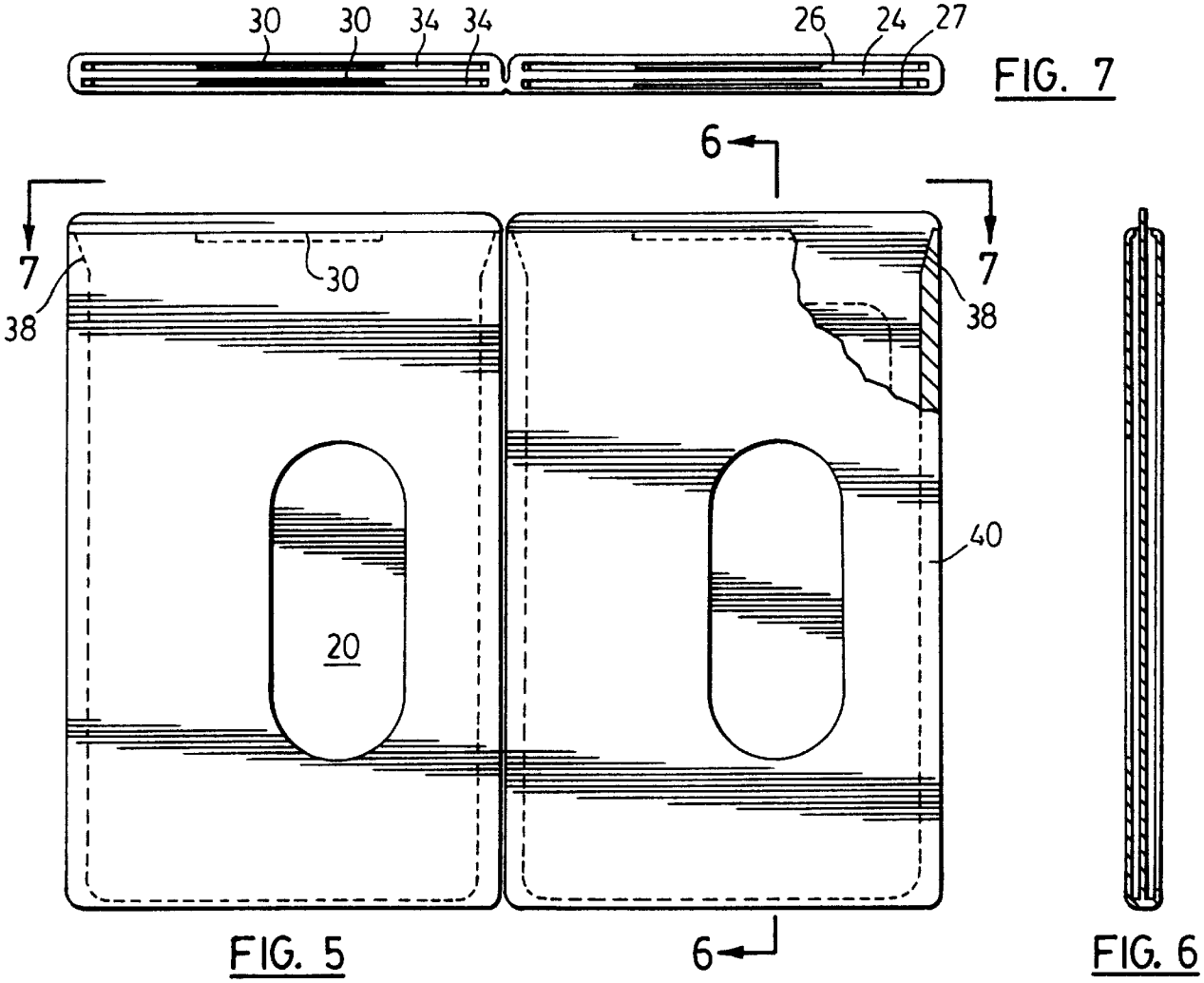
FIG. 5 is a perspective view, partly in section, showing the card storage area and the separating rib.
FIG. 6 is a cross-sectional view along the line 6—6 of the view shown in FIG. 5.

Referring now to FIGS. 5, 6, and 7, a case with two sections is shown. Each section, has an outer panel 26 and an inner panel 27 between which is interposed a central dividing panel 24. All three panels have slightly rounded corners 28 as shown on FIG. 4. Each of the inner, outer and central panels is shaped and sized in close proximity to a standard credit card.

In the particular embodiment shown in FIGS. 1 and 2 the inner panel 27 of both sections 12 and 14 is provided with a large central opening 16. The opening is sized and configured to reveal a large percentage of a card 36 located in the case. Such a large central opening would be suitable for photo identification which must be presented by a user for examination. The large central opening 16 allows examination to occur without removal from the case 10.

Still referring to the embodiment shown in FIGS. 1 and 2, the outer panels 26 are also provided with a smaller opening 20, which again permits part of a card 36 to be visible. The purpose of such an opening is two-fold: firstly to permit a user to identify the card in a particular location in the case 10, and secondly to permit a user to actuate removal of a card by pushing on the card to slide it out of the case.

While openings 16 and 20 are shown in one preferred embodiment depicted and described herein, it is clear that such openings are optional. The shape, size and location of the openings are also variable and could be modified in a variety of ways. Whatever the parameters of the opening, the functionality achieved by same simply relates to the ability to identify a card and to assist with the removal and insertion of the cards. For this a variety of opening types would suffice.

Referring now to FIGS. 5–7, the internal structure of each section of the case 10 is shown. The inner panel 26, the outer panel 27 and the central panel 24 are joined together to form an integral unit, most likely fabricated via an injection molding process. The three main panels are separated to permit openings 34 into which a card 36 can be inserted and stored. Each opening is defined by side walls 40 and a bottom wall 42, which joins the bottom of the side walls. The top of the side walls 38 is flared outwardly in a "V" shape to create a wider opening, or receiving area 44, to permit easier insertion of a card 36 into the case 10. The receiving area 44 is further defined by having the central dividing panel 24 being slightly longer than inner panel 26 and outer panel 27. This is shown on FIG. 6.

Referring again to FIGS. 5 and 7, a separating rib 30 is shown located on each outer and inner panel near the card receiving area 44. The separating rib 30 maintains a gap between outer and inner panels 26 and 27, and the central dividing panel 24, so as to make available a gap into which a card 36 may be inserted easily and quickly. In the embodiment shown, the rib extends approximately ½ the width of the receiving area. Again however various configurations and sizes or separating means may be utilized.

The rib 30 also has another function which is to provide audible feedback to a user when a card 36 is inserted or removed into the case 10. This would occur primarily on cards with either raised or embossed numbers such as a typical credit or debit card. Obviously, smooth-surfaced cards such as some security passes or other identification cards would not provide audible feedback. The audible feedback is generated when a card is inserted or removed into the case and the raised numbers of the card come in contact with the rib 30. The audible feedback provides confirmation to the user that the card is being properly inserted into or removed from the case.

Figure 8:
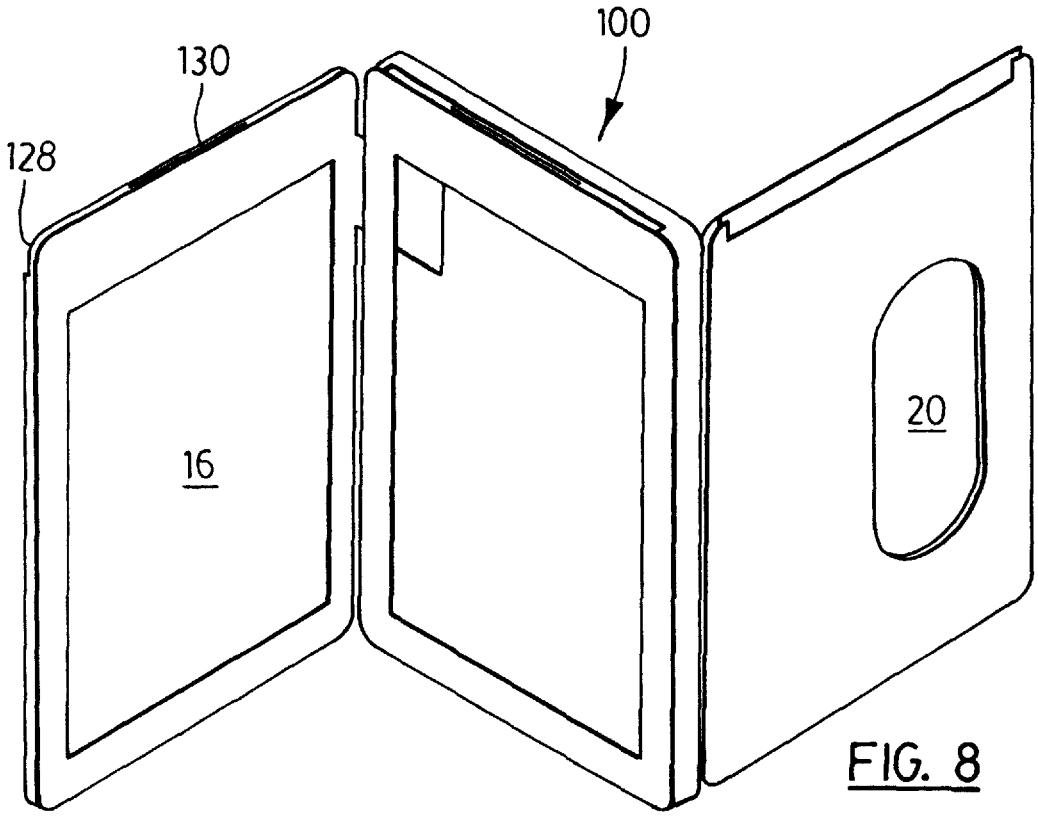
FIG. 8 is a perspective view of a second embodiment of the card holder.
Figure 9:
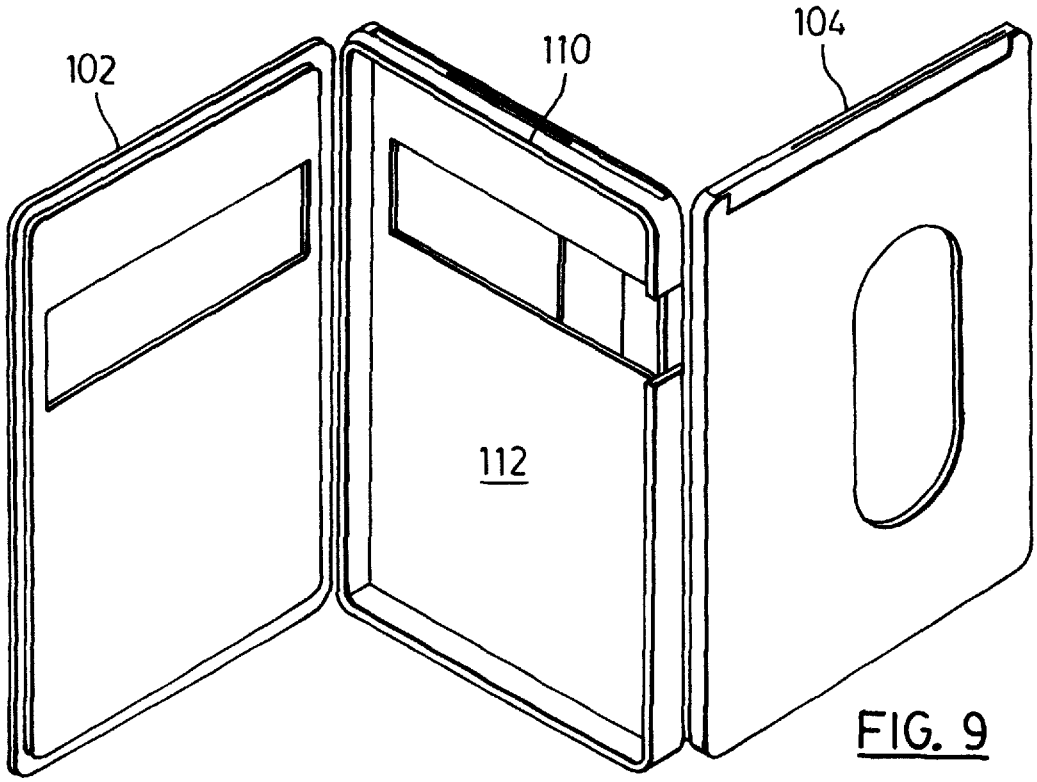
FIG. 9 is a perspective view of a second embodiment of the card holder showing the reverse side.

Referring now to FIGS. 8 and 9, a second embodiment of the invention is shown. This embodiment is a higher capacity case 100 which includes two outer sections 102 and 104 and a central or middle section 110. Again, openings 116 and 120 are provided in both the inner and outer panels of the outer sections in a similar fashion to the first described embodiment. The middle section 110 includes a central card storage area 112 having an increased depth capable of housing an additional two or more cards. Thus the total storage capacity for the high capacity case 100 is six cards or more, ideal for users who are required to carry a larger number of cards. Cards 36 are simply laid into the central storage area 112 on top of each other. On the back of the middle section 110 a standard card storage area with separating rib 30 can be seen into which a card can be stored in a similar fashion to the outer sections 102 and 104.

Alternatively, other configurations are possible, including one which has three or more of the virtually the identical sections shown in FIG. 3.

In the embodiment shown in FIGS. 8 and 9 a latch means of some type (not shown) may be utilized to ensure the case is maintained in the closed position when desired. Furthermore, the embodiment shown in FIGS. 1 to 7 (with the exception of FIG. 3) may also include a latch means of some type (again not shown) to ensure closure. A variety of standard latch means could be employed all of which would be obvious to a person skilled in the art.

It will be appreciated that the above description relates to the preferred and alternative embodiments by way of example only. Many variations on the invention will be obvious to those knowledgeable in the field, and such obvious variations are within the scope of the invention as described and claimed, whether or not expressly described.

What is claimed as the invention is:

1. A credit card case comprising:

at least one card-carrying section comprising, two outer panels and a central dividing panel, said panels being joined together to form first and second card storage areas, each said card storage area having side walls, a bottom wall, and an open top or receiving area, and each said card storage area being appropriately sized and configured to house standard-sized credit, debit and identification cards.

2. A credit card case according to claim 1, wherein said central dividing panel is slightly longer than said outer panels.

3. A credit card case according to claim 1, further comprising a retention means in each card storage area.

4. A card case according to claim 3, wherein the retention means is located near the top of each outer panel.

5. A credit card case according to claim 3, wherein the retention means is a protruding rib extending partway across the top of the outer panels in the card storage areas, said rib.

6. A credit card case according to claim 1, wherein each card storage area has a tapered receiving area to facilitate insertion and removal of a card.

7. A credit card case according to claim 1, wherein the case includes two card-carrying sections joined together by a hinge.

8. A credit card case according to claim 1, wherein the case includes three card-carrying sections joined together by hinges.

9. A credit card case according to claim 1, wherein the case includes first and second card-carrying sections joined together by hinges to a third, larger card storage area.

* * * * *